US008210229B2

(12) United States Patent
Kirby

(10) Patent No.: US 8,210,229 B2
(45) Date of Patent: Jul. 3, 2012

(54) ROLLER SHADE SYSTEM HAVING A PLEATED SHADE FABRIC

(75) Inventor: David A. Kirby, Zionsville, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 13/162,978

(22) Filed: Jun. 17, 2011

(65) Prior Publication Data

US 2011/0240233 A1 Oct. 6, 2011

Related U.S. Application Data

(62) Division of application No. 12/430,458, filed on Apr. 27, 2009, now Pat. No. 8,042,597.

(51) Int. Cl.

| | |
|---|---|
| ***A47G 5/02*** | (2006.01) |
| ***A47H 1/00*** | (2006.01) |
| ***A47H 13/14*** | (2006.01) |
| ***A47H 23/01*** | (2006.01) |

(52) U.S. Cl. ..... 160/238; 160/348; 160/349.1

(58) Field of Classification Search ..... 160/310, 160/348, 238, 352, 23.1, 32, 84.01; 242/615, 242/615.3; 223/85, 95, 88, 96, 28–36; 38/12, 38/102.91; 112/147, 145, 146; 493/427, 493/442, 480, 446–448

See application file for complete search history.

(56) References Cited

U.S. PATENT DOCUMENTS

| | | | |
|---|---|---|---|
| 85,922 | A | 1/1869 | Fuzzard |
| 128,722 | A | 7/1872 | Gird |
| 1,549,535 | A | 8/1925 | Gray |
| 3,116,097 | A | 12/1963 | Novales |
| 3,160,202 | A | 12/1964 | Rosen |
| 3,783,456 | A | 1/1974 | Doan |
| 3,784,186 | A | 1/1974 | Lenthal et al. |
| 5,467,266 | A | 11/1995 | Jacobs et al. |

(Continued)

FOREIGN PATENT DOCUMENTS

| | | | |
|---|---|---|---|
| GB | 2112273 | A | 7/1983 |

OTHER PUBLICATIONS

European Patent Office, International Search Report and Written Opinion for International Patent Application No. PCT/US2009/053393, Jul. 7, 2011, 10 pages.

*Primary Examiner* — Blair M Johnson

*Assistant Examiner* — Jaime F Cardenas-Garcia

(74) *Attorney, Agent, or Firm* — Mark E. Rose; Philip N. Smith; Bridget L. McDonough

(57) ABSTRACT

A pleated roller shade system allows a thin flexible shade fabric, such as, for example, silk, to be wrapped around a roller tube. The system comprises a pleating hembar contained within a hembar pocket of the shade fabric. The hembar is characterized by a non-linear shape, such as a serpentine shape, for causing the shade fabric to hang with a plurality of pleats. The hembar may comprise a plurality of C-shaped hembar sections flexibly coupled to each other. The system may also comprise an elongated pleating assembly mounted parallel to the roller tube and having a fabric-receiving opening that defines a non-linear (e.g., serpentine) path. The shade fabric may be received through the fabric-receiving opening and folded by the pleating assembly, such that the shade fabric is wrapped around the roller tube in folds as the roller tube rotates.

20 Claims, 8 Drawing Sheets

U.S. PATENT DOCUMENTS

| | | | |
|---|---|---|---|
| 6,100,659 | A | 8/2000 | Will et al. |
| 6,155,326 | A | 12/2000 | Imhoff et al. |
| 6,201,364 | B1 | 3/2001 | Will et al. |
| 6,497,267 | B1 | 12/2002 | Azar et al. |
| 6,845,806 | B2 | 1/2005 | Gottschall et al. |
| 6,983,783 | B2 | 1/2006 | Carmen, Jr. et al. |
| 7,063,124 | B2 | 6/2006 | Walker et al. |
| 7,163,044 | B2 | 1/2007 | Kirby |
| 7,281,565 | B2 | 10/2007 | Carmen, Jr. et al. |
| 7,802,609 | B2 | 9/2010 | Kirby |
| 8,042,597 | B2 | 10/2011 | Kirby |
| 2005/0205217 | A1 | 9/2005 | Harper et al. |
| 2010/0038039 | A1 | 2/2010 | Kirby |
| 2010/0043985 | A1 | 2/2010 | Kirby |
| 2010/0314052 | A1 | 12/2010 | Kirby |

ROLLER SHADE SYSTEM HAVING A PLEATED SHADE FABRIC

RELATED APPLICATIONS

This application is a divisional application of commonly-assigned U.S. patent application Ser. No. 12/430,458, now U.S. Pat. No. 8,042,597 filed Apr. 27, 2009, entitled ROLLER SHADE SYSTEM HAVING A HEMBAR FOR PLEATING A SHADE FABRIC, the entire disclosure of which is herein incorporated by reference.

BACKGROUND OF THE INVENTION

1. Field of the Invention

The present invention relates to a motorized window treatment, and more particularly, to a motorized roller shade system for winding receipt of a thin, pleated fabric around a roller tube.

2. Description of the Related Art

Typical window treatments, such as, for example, roller shades, draperies, roman shades, and venetian blinds, are mounted in front of windows to prevent sunlight from entering a space and to provide privacy. A roller shade includes a flexible shade fabric wound onto an elongated roller tube. The flexible shade fabric typically includes a weighted hembar at a lower end of the shade fabric, such that the shade fabric hangs in front of the window. Motorized roller shades include a drive system engaging the roller tube to provide for tube rotation, such that the lower end of the shade fabric can be raised and lowered (i.e., moved in a vertical direction) by rotating the roller tube.

Many thin and flexible fabrics, such as, for example, silk, are not suitable for use with prior art roller shades, since the thin fabrics tend to not hang flat and tend not to roll up evenly on the roller tube. Therefore, such thin fabrics are typically laminated to a stiffer backing to be wound about a roller tube. While the lamination allows the thin fabrics to be used with a roller shade, the thin fabrics loose their soft look and feel as a result of this process.

Prior art draperies have allowed for horizontal movement of a suspended pleated drapery fabric covering a window or other opening. These prior art draperies have required additional space to be provided on the sides of the window or opening to hold the drapery fabric when the drapery is fully open. This prevents the draperies from being used to cover windows where there is little space at the sides of the windows.

Accordingly, there is a need for a roller shade system having a thin, flexible shade fabric that allows the shade fabric to hang with pleats and to be wrapped around a roller tube (i.e., moved in a vertical direction).

SUMMARY OF THE INVENTION

According to an embodiment of the present invention, a roller shade system comprises a rotatably-mounted roller tube, a flexible shade fabric windingly received around the roller tube, and a pleating hembar for causing the shade fabric to hang with a plurality of pleats. The shade fabric has a first fabric end connected to the roller tube and a second fabric end opposite the first fabric end. The second fabric end is adapted to move in an upward direction and in a downward direction as the roller tube is rotated in respective first and second directions. The pleating hembar is contained within a hembar pocket at the second fabric end of the shade fabric. The pleating hembar is characterized by a non-linear shape for causing the shade fabric to hang with the plurality of pleats.

According to another embodiment of the present invention, the roller shade system may also comprise an elongated pleating assembly defining a fabric-receiving opening and mounted parallel to the roller tube such that the shade fabric is received through the fabric-receiving opening. The pleating assembly is adapted to fold the shade fabric, such that the shade fabric is wrapped around the roller tube in folds as the roller tube rotates in the first direction to move the second fabric end of the shade fabric in the upward direction.

According to another aspect of the present invention, a pleating hembar adapted to be installed in a hembar pocket of a flexible shade fabric comprises a plurality of C-shaped hembar sections having first and second ends. The first end of each hembar section is adapted to be coupled to the second end of another adjacent hembar section, such that each of the hembar sections is operable to rotate with respect to the adjacent hembar portion. In addition, each hembar section may comprise an elongated portion surrounded by two curved portions, where the hembar sections are coupled together via interlocking structures. Further, the hembar may be characterized by a serpentine shape.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
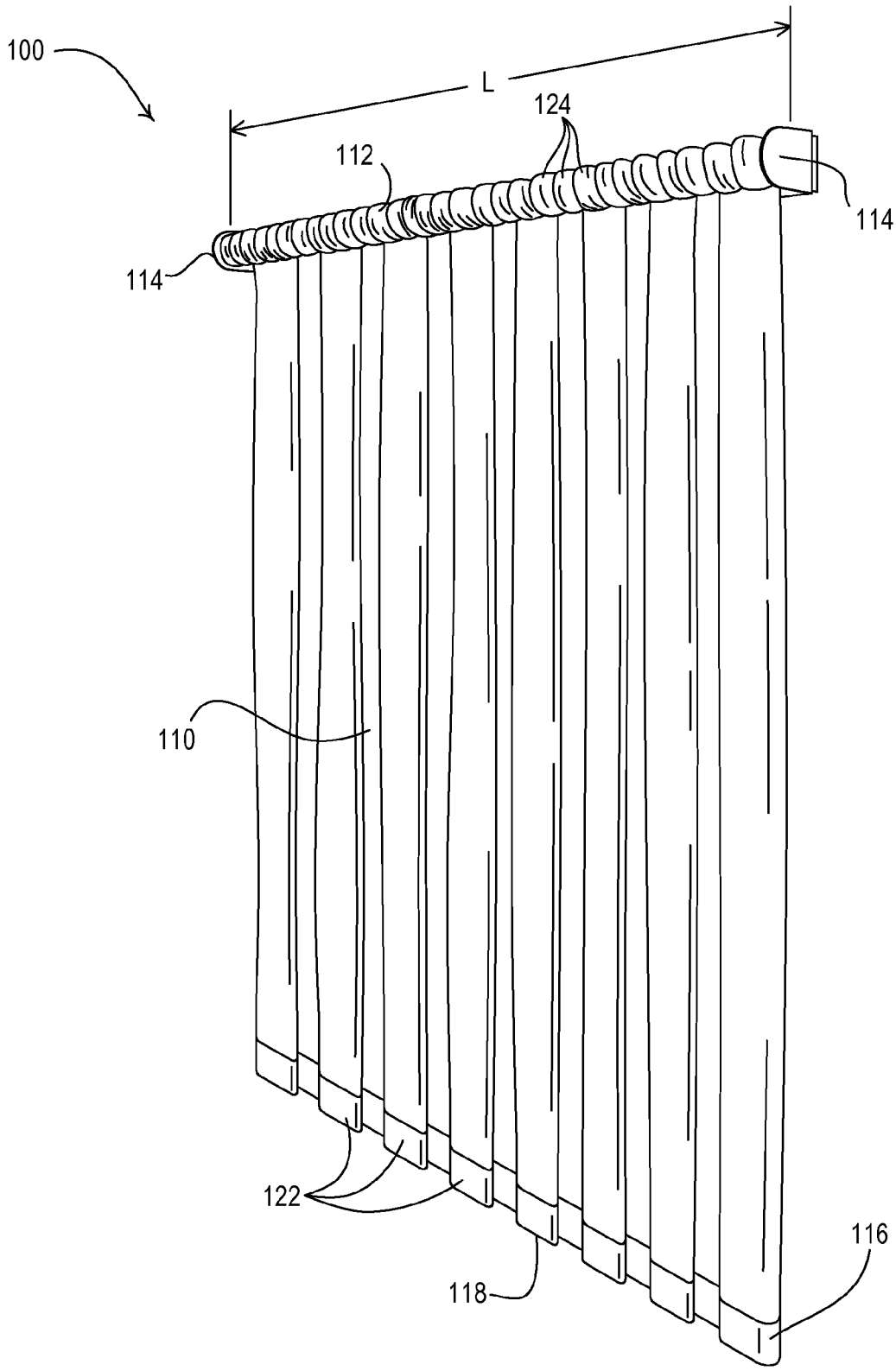
FIG. 1 is a perspective view of a pleated roller shade system having a pleated shade fabric according to a first embodiment of the present invention.

The foregoing summary, as well as the following detailed description of the embodiments of the present invention, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 11:
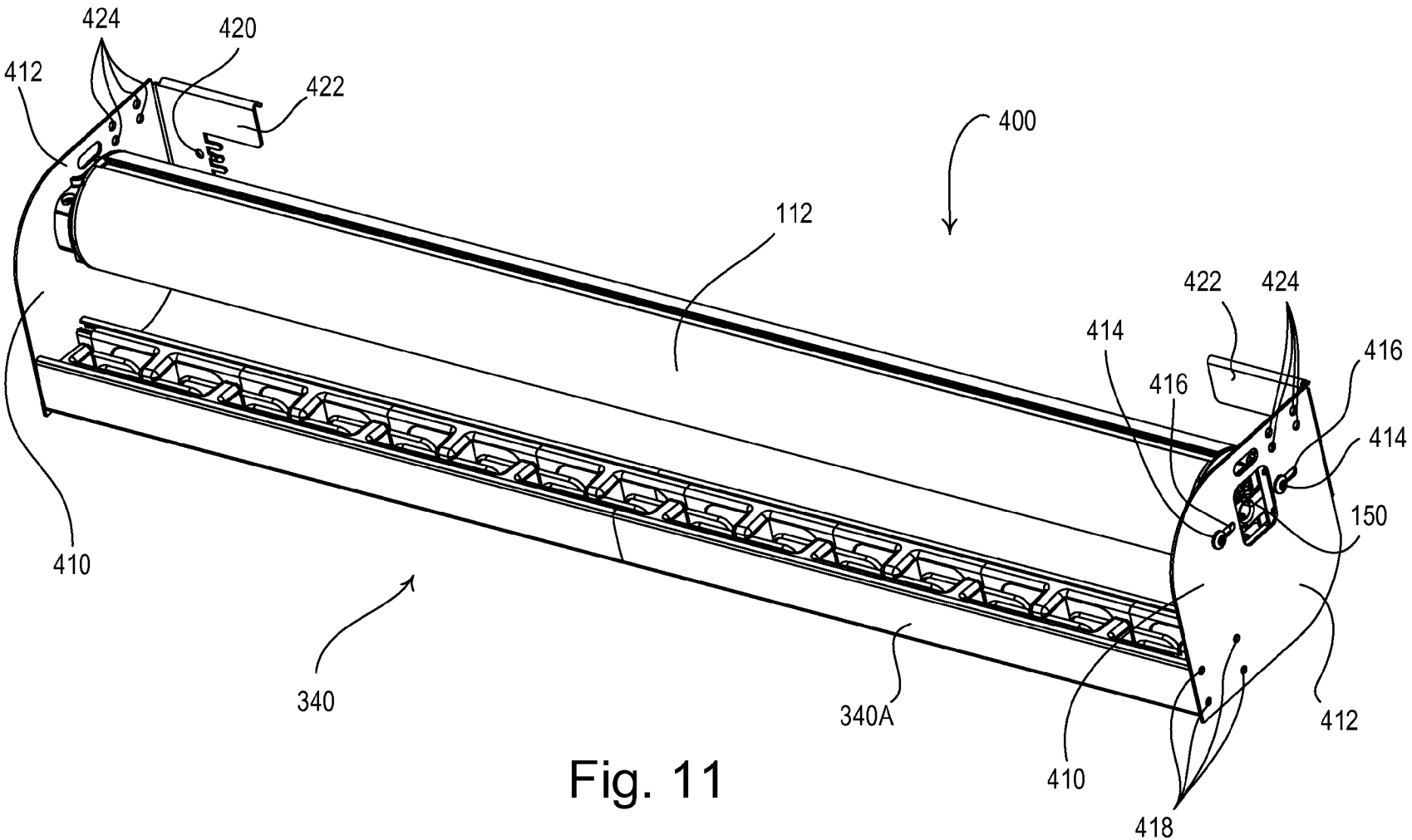
FIG. 11 is a perspective view of a pleated roller shade system according to a fourth embodiment of the present invention.

FIG. 1 is a perspective view of a pleated roller shade system 100 having a pleated shade fabric 110 that is windingly received around a roller tube 112 according to a first embodiment of the present invention. The shade fabric 110 has a first fabric end connected to the roller tube and a second fabric end opposite the first fabric end. The roller tube 112 has two opposite tube ends and extends between the opposite tube ends for a length L (as shown in FIG. 1). The roller tube 112 is rotatably coupled at the tube ends to two mounting brackets 114, which are connected to a vertical surface, e.g., a wall. The shade fabric 110 comprises a hembar pocket 116 at a bottom edge 118 (i.e., the second fabric end) of the shade fabric. The bottom edge 118 of the shade fabric 110 moves in an upward direction and in a downward direction as the roller tube 112 rotates in respective first and second angular directions. The pleated roller shade system 100 may also comprise a drive system (e.g., a motor drive unit 150 mounted inside the roller tube 112 as shown in FIG. 11) to allow for control of the rotation of the roller tube 112 by a user of the roller shade system. An example of the motor drive unit 150 is described in greater detail in U.S. Pat. No. 6,983,783, issued Jan. 10, 2006, entitled MOTORIZED SHADE CONTROL SYSTEM, the entire disclosure of which is hereby incorporated by reference.

Figure 2:
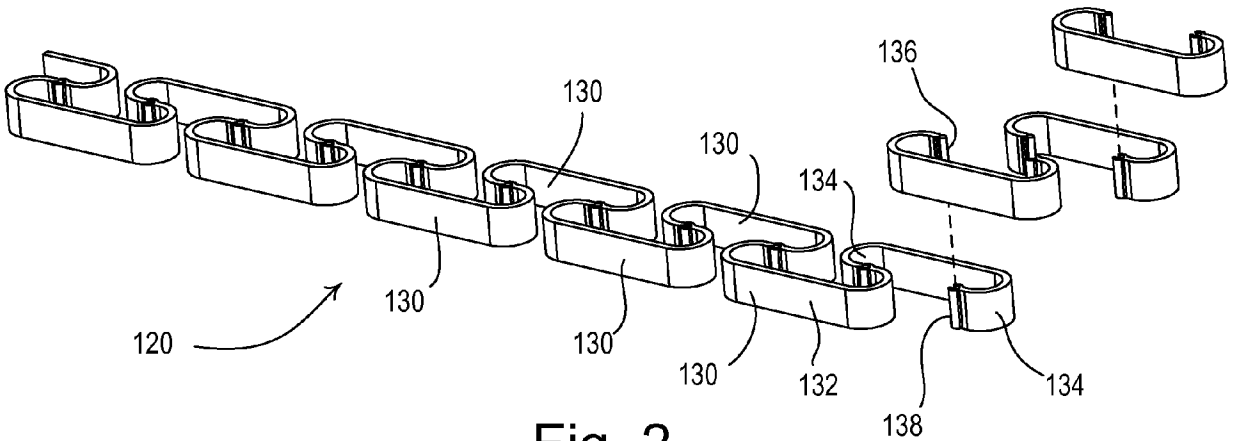
FIG. 2 is a perspective view of a pleating hembar of the pleated shade system of FIG. 1.
Figure 3:
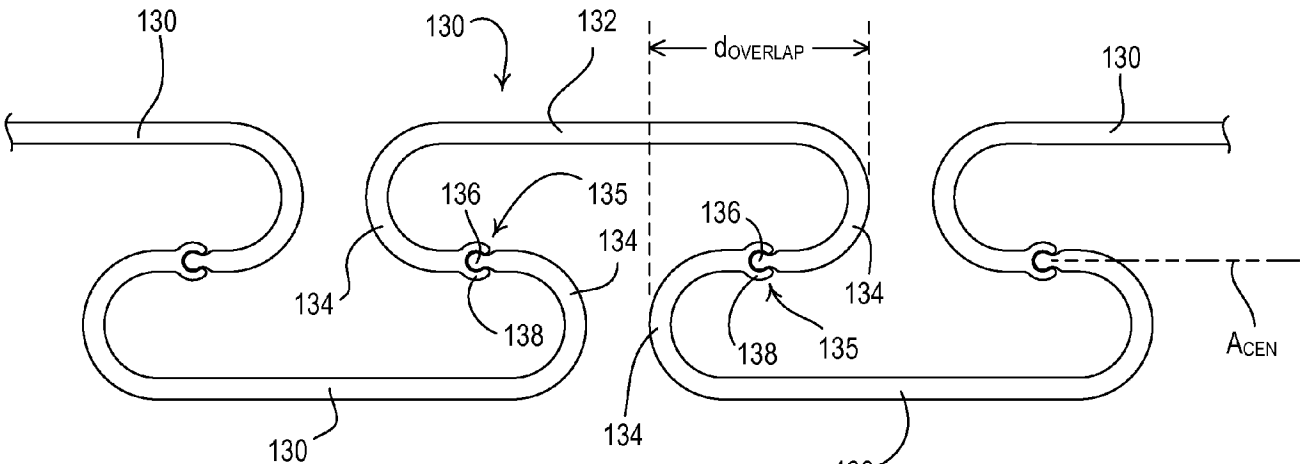
FIG. 3 is a partial top view of the pleating hembar of FIG. 2.

The hembar pocket 116 is adapted to hold a weighting element, e.g., a pleating hembar 120 (FIG. 2) that allows the shade fabric 110 to hang from the roller tube 112. FIG. 2 is a perspective view and FIG. 3 is a partial top view of the pleating hembar 120 according to the first embodiment of the present invention. The pleating hembar 120 has a non-linear shape (e.g., a serpentine shape) and operates to pleat the shade fabric 110, such that the shade fabric hangs with a plurality of pleats 122 as shown in FIG. 1. The shade fabric 110 may be sewn near the top edge that connects to the roller tube 112 (i.e., the first fabric end opposite the bottom edge 118), such that the shade fabric wraps around the roller tube in a plurality of folds 124 (i.e., when the roller tube is rotated in the first angular direction to move the bottom edge 118 in the upward direction).

Because the shade fabric 110 is folded as the shade fabric is wrapped around the roller tube 112 and the pleating hembar 120 causes the fabric to hang in the pleats 122, the total width of the unwrapped shade fabric is substantially greater than the length L of the roller tube. For example, the total width of the unwrapped shade fabric 110 may be twice as long as the length L of the roller tube 112. The width of the unwrapped shade fabric 110 is defined as the distance between the opposites sides of the shade fabric (i.e., measured in the same direction as the length L of the roller tube 112 shown in FIG. 1) when the shade fabric is pulled taunt.

Figure 4A:
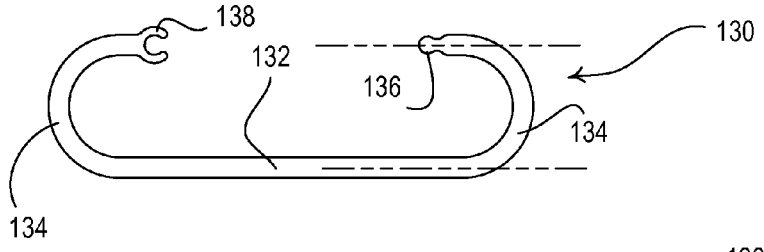
FIG. 4A is a top view of one of a plurality of hembar portions of the pleating hembar of FIG. 2.
Figure 4B:
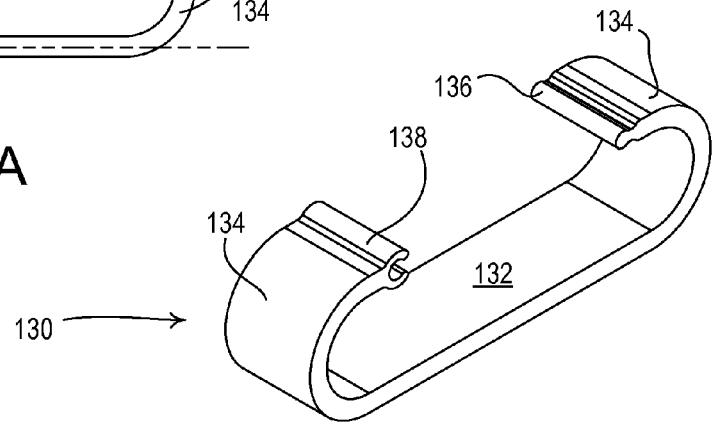
FIG. 4B is a perspective view of hembar portion of FIG. 4A.

The pleating hembar 120 is constructed from a plurality of C-shaped hembar sections 130. FIG. 4A is a top view and FIG. 4B is a perspective view of one of the hembar sections 130 according to the first embodiment of the present invention. Each hembar section 130 comprises an elongated portion 132 surrounded by two curved (e.g., semi-circular) portions 134. The hembar sections 130 are coupled together via interlocking structures 135 (as shown in FIG. 3). Specifically, each hembar section 130 comprises an interior interlocking portion 136 at a first end of the hembar section (i.e., at the end of one of the curved portions 134) and an exterior interlocking portion 138 at a second end of the hembar section (i.e., at the end of the opposing curved portion). The interior interlocking portion 136 of one hembar section 130 is received within the exterior interlocking portion 138 of an adjacent hembar section to connect the two hembar sections together (as shown in FIG. 3).

Each hembar section 130 is able to pivot about an axis defined by the respective interior interlocking portion 136, such that the hembar sections are pivotably (i.e., flexibly) attached to each other. Accordingly, each hembar section 130 is operable to rotate with respect to the adjacent connected hembar section. This flexible attachment of the hembar sections 130 allows the pleats 122 of the shade fabric 110 to hang in a more natural fashion. The interior interlocking potions 136 extend in a plane that is substantially parallel to a plane of the elongated portion 132 (as shown by the dashed lines of FIG. 4A), such that the connected hembar sections 130 form the serpentine pattern as shown in FIG. 3. Accordingly, there is a resulting overlap $d_{OVERLAP}$ of the shade fabric 110 (as shown in FIG. 3).

To assemble the roller shade system 100, the shade fabric 110 is first attached to the roller tube 112 and the pleating hembar 120 is then installed into the hembar pocket 116, which is open at both ends (i.e., at the sides of the shade fabric). Before the pleating hembar 120 is inserted into the hembar pocket 116, the hembar sections 130 are connected together via the interlocking structures 135. The pleating hembar 120 is rotated approximately 90° about a central axis $A_{CEN}$ of the pleating hembar (as shown in FIG. 3) and then inserted into the hembar pocket 116. When the pleating hembar 120 is fully inserted into the hembar pocket 116, the pleating hembar may be rotated back approximately 90° about the central axis $A_{CEN}$ of the pleating hembar, such that the pleats 122 are formed in the shade fabric 110. The shade fabric 110 is then wound onto the roller tube 112, such that the roller tube, shade fabric, and pleating hembar 120 may be shipped in this state.

Figure 5A:
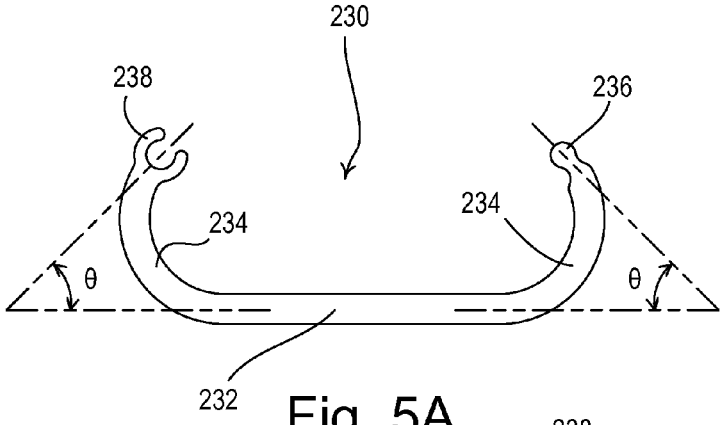
FIG. 5A is a top view of a hembar portion of a pleating hembar according to a second embodiment of the present invention.
Figure 5B:
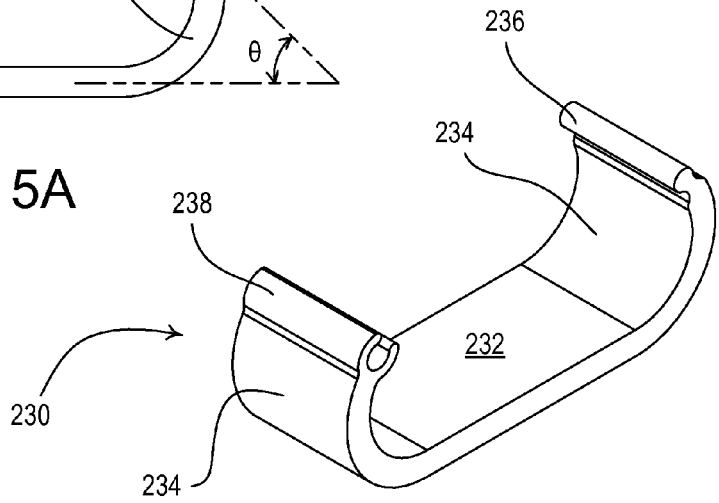
FIG. 5B is a perspective view the hembar portion of FIG. 5A.

FIG. 5A is a top view and FIG. 5B is a perspective view of a hembar section 230 according to a second embodiment of the present invention. The hembar section 230 comprises an elongated portion 232 surrounded by two curved portions 234, at the ends of which are either an interior interlocking portion 236 or an exterior interlocking portion 238. The interior and exterior interlocking potions 236, 238 extend in a plane that is oriented at an angle θ (e.g., approximately) 45° with respect to a plane of the elongated portion 232 (as shown in FIG. 5A), such that the hembar sections 230 form a serpentine shape when connected together. Accordingly, there is not as much overlap of the shade fabric 110 when the hembar sections 230 of the second embodiment are used (as compared to the hembar sections 130 of the first embodiment).

Figure 6:
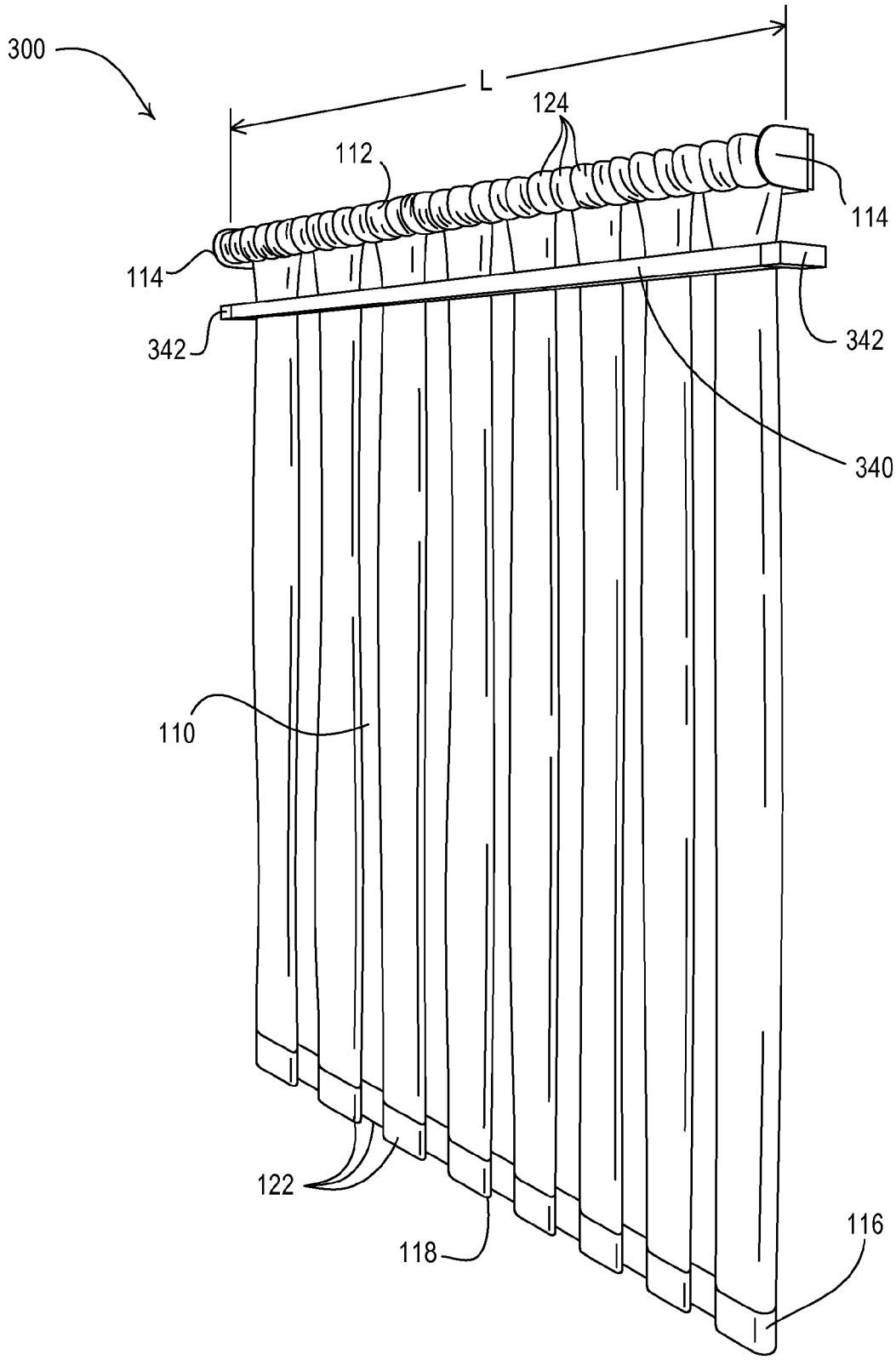
FIG. 6 is a perspective view of a pleated roller shade system having a pleated shade fabric and a pleating assembly according to a third embodiment of the present invention.

FIG. 6 is a perspective view of a pleated roller shade system 300 comprising an elongated pleating assembly 340 (i.e., a "pleating bar") according to a third embodiment of the present invention. The pleating assembly 340 is adapted to be mounted to the wall below the roller tube 112 via mounting ends 342. The shade fabric 110 slides through the pleating assembly 340 as the roller tube 110 rotates to further assist in causing the shade fabric to form the pleats 122. The pleating assembly 340 also operates to fold the shade fabric 110 into the plurality of folds 124 as the shade fabric is wound around the roller tube 112 (i.e., when the roller tube is rotated in the first angular direction to move the bottom edge 119 in the upward direction). Alternatively, the roller tube 112 and the pleating assembly 340 could be mounted to a horizontal surface (e.g., a ceiling), or between the sides of an opening (e.g., a window). The pleating assembly is described in greater detail in U.S. patent application Ser. No. 12/193,089, filed Aug. 18, 2008, entitled ROLLER SHADE SYSTEM HAVING A PLEATED FABRIC, the entire disclosure of which is hereby incorporated by reference.

Figure 7:
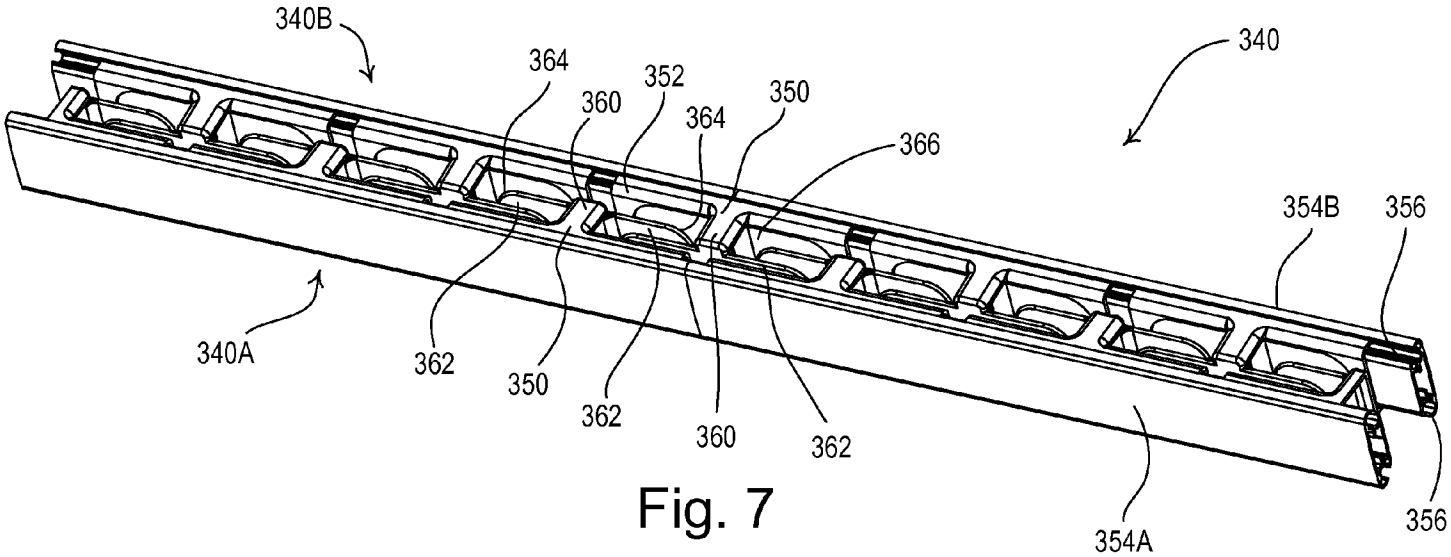
FIG. 7 is a perspective view of a portion of the pleating assembly of the pleated roller shade system of FIG. 6.
Figure 8:
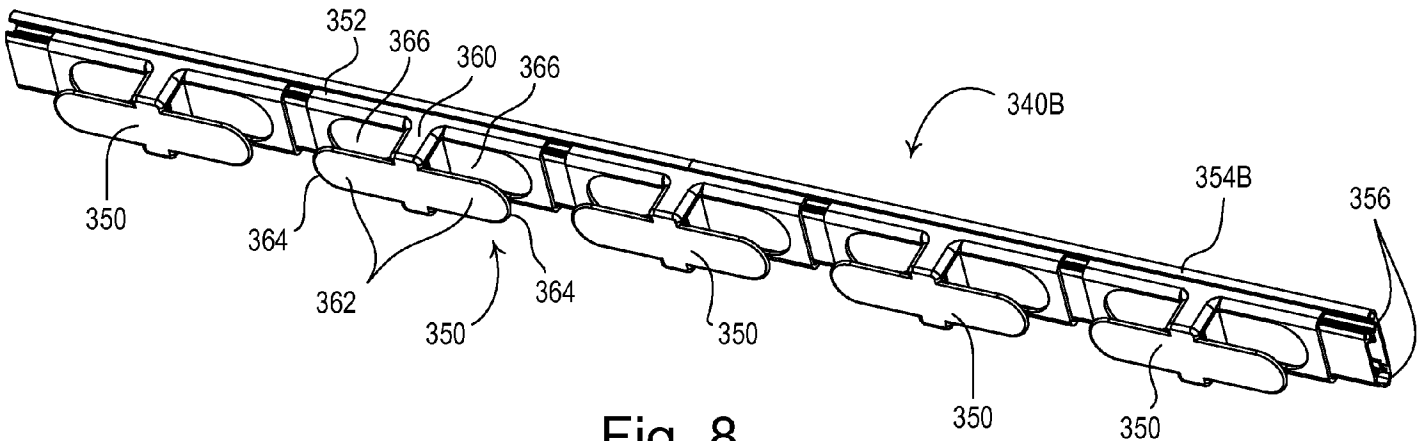
FIG. 8 is a perspective view of a portion of one of two pleating structures of the pleating assembly of FIG. 7.
Figure 9:
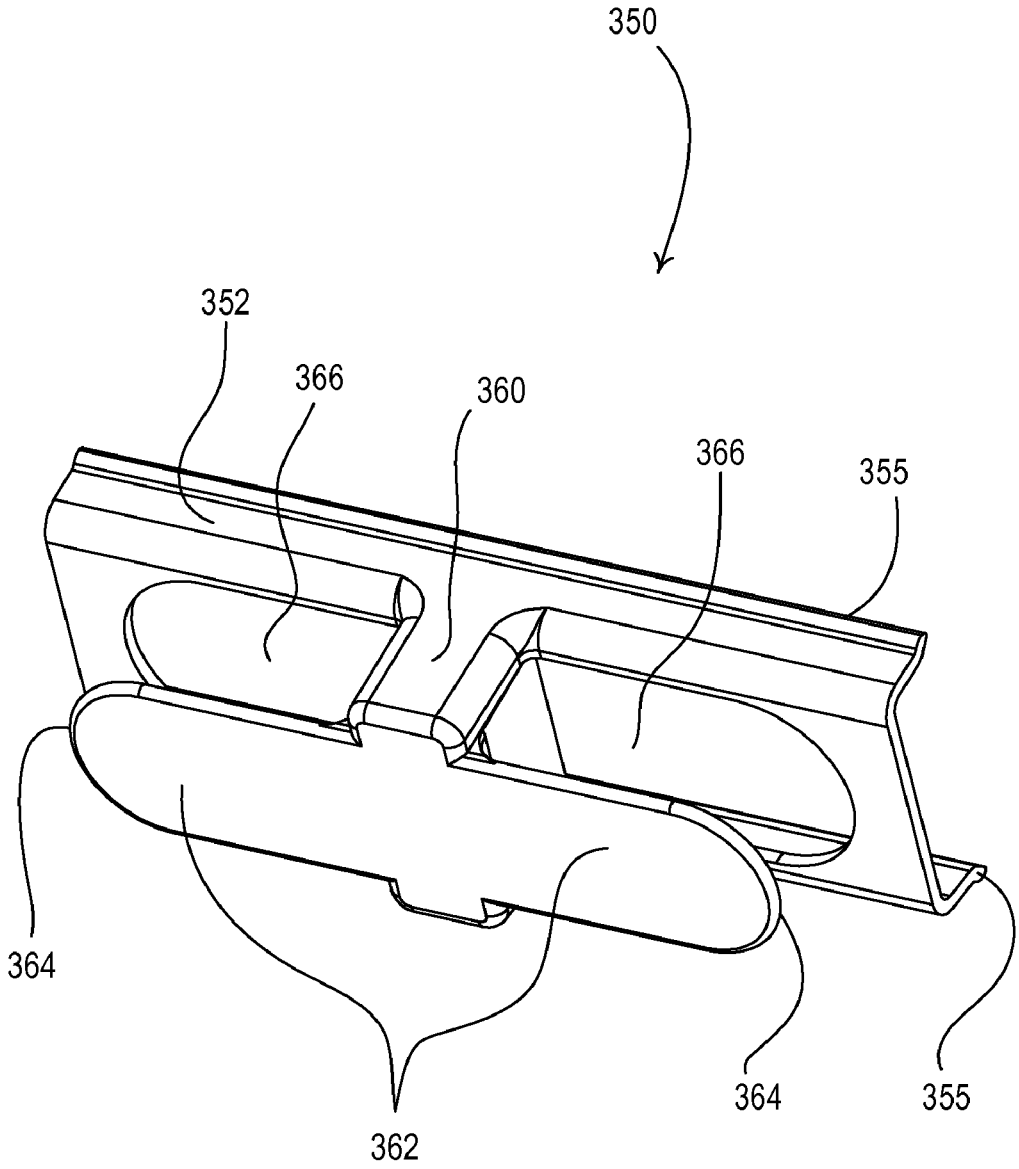
FIG. 9 is a perspective view of one of a plurality of pleating elements of the pleating assembly of FIG. 7.

FIG. 7 is a perspective view of a portion of the pleating assembly 340, which comprises two parallel pleating structures 340A, 340B. FIG. 8 is a perspective view of a portion of one of the pleating structures 340B of the pleating assembly 340. FIG. 9 is a perspective view of one of a plurality of pleating elements 350 of the pleating assembly 340. Each pleating element 350 comprises a base 352 for mounting to one of two support bars 354A, 354B. The support bars 354A, 354B are oriented parallel to each other along the length of the pleating assembly 340. Each of the pleating elements 350 has flanges 355 (FIG. 9) that are received within slots 336 of the supports bars 354A, 354B, such that the pleating elements 350 may be slid across the length of the support bars. The pleating elements 350 are spaced apart at intervals from each other along the length of the supports bars 354A, 354B. The pleating elements 350 also have projections 360 that define, for example, "T-shaped" structures. Each projection 360 has two extensions 362 that are oriented parallel to the base 352 (i.e., parallel to the support bars 354A, 354B) and have rounded edges 364. A gap 366 is formed between the extensions 362 of the projections 360 and the base 352 of the pleating elements 350.

Figure 10:
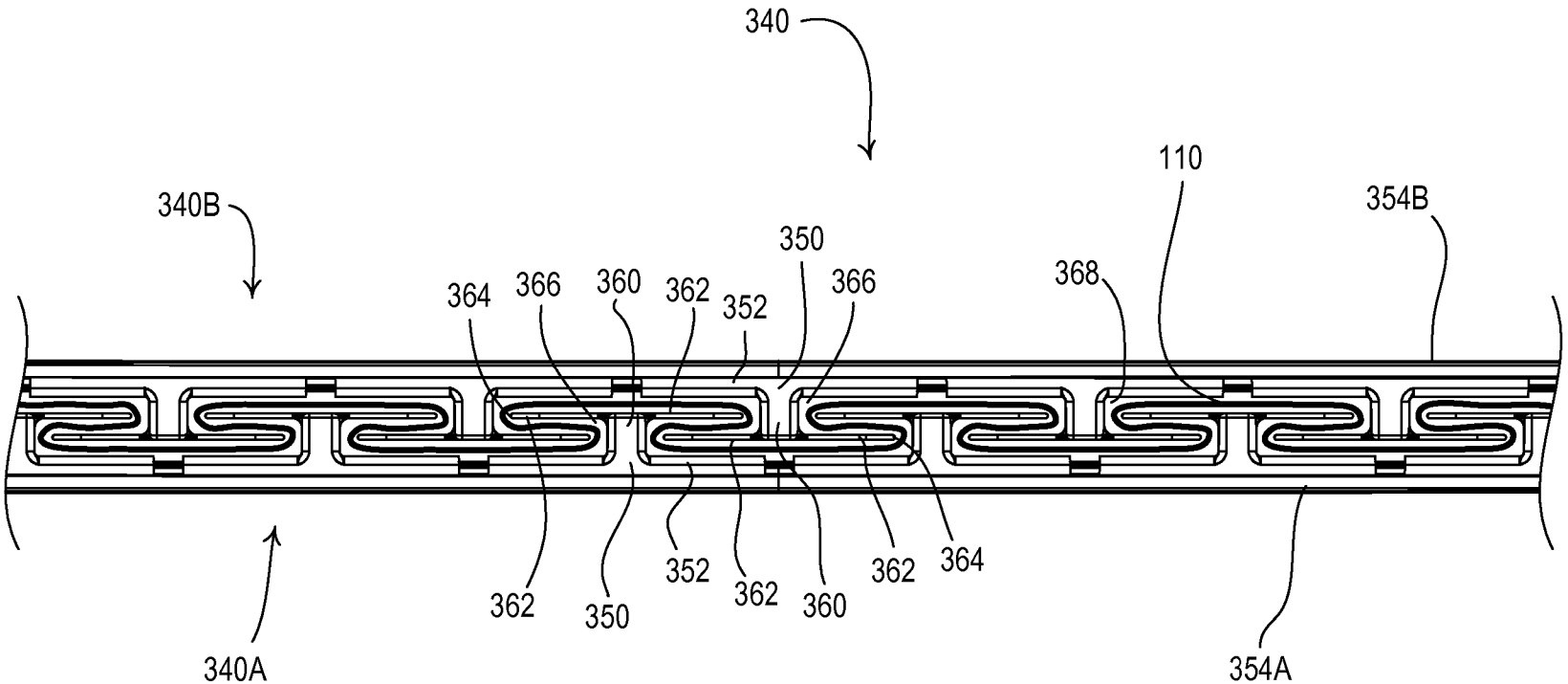
FIG. 10 is a partial top view of the pleating assembly of FIG. 7 showing the shade fabric received through the pleating assembly.

FIG. 10 is a partial top view of the pleating assembly 340 showing the shade fabric 110 received through the pleating assembly. The two parallel pleating structures 340A, 340B are mounted such that the projections 360 of the pleating elements 350 connected to the first and second support bars 354A, 354B extend towards the second and first support bars, respectively. The extensions 362 of the pleating elements 350 connected to the first support bar 354A are received within the gaps 366 of the pleating elements 350 connected to the second support bar 354B (and vice versa). Accordingly, a fabric-receiving opening 368 defining a non-linear path (e.g., a serpentine path) is provided between the two parallel pleating structures 340A, 340B. The shade fabric 110 is received through the fabric-receiving opening 368, such that the shade fabric assumes a non-linear, serpentine shape when viewed from above as shown in FIG. 10.

Because the projections 360 of the pleating elements 350 have T-shaped structures and the extensions 362 are provided in the gaps 366 of the pleating elements, there is overlap of the shade fabric 110 as the shade fabric wraps onto the roller tube 112 allowing the pleating assembly 340 to fold the shade fabric 110 as the shade fabric wraps around the roller tube (i.e., into folds 124). Therefore, the thickness of shade fabric wrapped around the roller tube 112 is minimized and bunching of the shade fabric is avoided. Since the pleated shade fabric 110 is neatly wrapped around the roller tube 112 when rolled up, the shade fabric is stored out-of-sight from a user and no additional space is need for storage of the fabric (e.g., at sides of a window that the roller shade system 100 is covering). The rounded edges 364 of the extensions 362 of the pleating elements 350 guide the shade fabric 110 through the fabric-receiving opening 368 without ripping or tearing the shade fabric.

FIG. 11 is a perspective view of a pleated roller shade system 400 according to a fourth embodiment of the present invention. The pleated roller shade system 400 comprises two mounting brackets 410 to which both the roller tube 112 and the pleating assembly 340 are mounted. The motor 150 is housed inside the roller tube 112, which is rotatably mounted to two side portions 412 of the mounting brackets 410. Specifically, the motor 150 is coupled one of the side portions 412 via screws 414 received through attachment openings 416. Further, the pleating assembly 340 is connected to the side portions 412 via attachment openings 418. The pleated roller shade system 400 may be mounted to a vertically-oriented wall via mounting holes 420 in rear portions 422 of the mounting brackets 410 or between the sides of an opening via mounting holes 424 in the side portions 412.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A roller shade system comprising:

a rotatably-mounted roller tube;

a flexible shade fabric windingly received around the roller tube, the shade fabric having a first fabric end connected to the roller tube and a second fabric end opposite the first fabric end, the shade fabric comprising a hembar pocket at the second fabric end, the second fabric end adapted to move in an upward direction and in a downward direction as the roller tube is rotated in respective first and second directions;

a pleating hembar contained within the hembar pocket, the pleating hembar characterized by a non-linear shape for causing the shade fabric to hang with a plurality of pleats; and an elongated pleating assembly defining a fabric-receiving opening and mounted parallel to the roller tube such that the shade fabric is received through the fabric-receiving opening, the pleating assembly adapted to fold the shade fabric, such that the shade fabric is wrapped around the roller tube in folds as the roller tube rotates in the first direction to move the second fabric end of the shade fabric in the upward direction.

2. The roller shade system of claim 1, wherein the pleating hembar comprises a plurality of C-shaped hembar sections having first and second ends, the first end of each hembar section adapted to be coupled to the second end of another adjacent hembar section.

3. The roller shade system of claim 2, wherein each hembar section comprises an elongated portion extending between two curved portions.

4. The roller shade system of claim 3, wherein the curved portions are semi-circular, such that the pleating hembar has a serpentine shape.

5. The roller shade system of claim 4, wherein the ends of the hembar sections extend towards each other in a plane that is parallel to the plane of the elongated portion.

6. The roller shade system of claim 4, wherein the ends of the hembar sections extend towards each other at angles of approximately 45° to the plane of the elongated portion.

7. The roller shade system of claim 3, wherein the hembar sections are coupled together via interlocking structures, the first end of each hembar section comprising an interior interlocking portion and the second end of each hembar section comprising an exterior interlocking portion.

8. The roller shade system of claim 7, wherein each hembar section is able to pivot about an axis defined by the respective interior interlocking portion, such that the hembar sections are pivotably attached to each other.

9. The roller shade system of claim 1, wherein the pleating assembly comprises first and second support bars oriented parallel to each other along the length of the pleating assembly, and a plurality of pleating elements coupled to the supports bars and spaced at intervals from each other, the pleating elements coupled to the first and second support bars extending towards the second and first support bars, respectively, such that the shade fabric assumes the non-linear shape.

10. The roller shade system of claim 9, wherein the pleating elements each comprise a projection defining a T-shaped structure, the projections of the pleating elements each comprising extensions having rounded edges.

11. The roller shade system of claim 10, wherein the support bars are mounted with respect to each other such that the fabric-receiving opening is formed between the pleating elements connected to the support bars, and the fabric-receiving opening forms a serpentine path.

12. The roller shade system of claim 9, wherein the pleating assembly is mounted below the roller tube such that the shade fabric hangs from the roller tube through the fabric-receiving opening to the second fabric end.

13. The roller shade system of claim 1, wherein the width of the shade fabric is greater than the length of the roller tube.

14. The roller shade system of claim 13, wherein the width of the shade fabric is approximately twice as long as the length of the roller tube.

15. The roller shade system of claim 1, wherein the shade fabric is sewn near the first fabric end such that the shade fabric wraps around the roller tube in a plurality of folds.

16. The roller shade system of claim 1, further comprising:

a motor drive system coupled to the roller tube for controlling of the rotation of the roller tube.

17. The roller shade system of claim 1, wherein there is a resulting length of overlap of the shade fabric in a direction parallel to the roller tube.

18. A roller shade system adapted to be mounted in front of a window, the roller shade system comprising:

a rotatably-mounted roller tube;

a flexible shade fabric windingly received around the roller tube and adapted to hang in front of the window, the shade fabric having a first fabric end connected to the roller tube and a second fabric end opposite the first fabric end, the shade fabric comprising a hembar pocket at the second fabric end, the second fabric end adapted to move in an upward direction as the roller tube rotates in the first direction, and in a downward direction as the roller tube rotates in the second direction;

a pleating hembar contained within the hembar pocket, the pleating hembar characterized by a non-linear shape for causing the shade fabric to hang with a plurality of pleats; and an elongated pleating assembly defining a fabric-receiving opening and mounted parallel to the roller tube such that the shade fabric is received through the fabric-receiving opening, the pleating assembly adapted to fold the shade fabric, such that the shade fabric is wrapped around the roller tube in folds as the roller tube rotates in the first direction to move the second fabric end of the shade fabric in the upward direction.

19. The roller shade system of claim 18, wherein the pleating hembar comprises a plurality of C-shaped hembar sections having first and second ends, the first end of each hembar section adapted to be coupled to the second end of another adjacent hembar section, each hembar section comprising an elongated portion extending between two curved portions.

20. The roller shade system of claim 19, wherein the hembar sections are coupled together via interlocking structures, the first end of each hembar section comprising an interior interlocking portion and the second end of each hembar section comprising an exterior interlocking portion.

* * * * *